United States Patent [19]

Kinard

[11] 4,122,209

[45] Oct. 24, 1978

[54] MAGNETIC IMAGE DECORATOR

[75] Inventor: Richard Dale Kinard, Newark, Del.

[73] Assignee: E. I. Du Pont de Nemours and Company, Wilmington, Del.

[21] Appl. No.: 788,669

[22] Filed: Apr. 18, 1977

[51] Int. Cl.[2] ..... G03G 13/09

[52] U.S. Cl. ..... 427/18; 118/657

[58] Field of Search ..... 427/14, 18, 47; 118/653, 656, 657, 658; 355/3 DD; 96/1 SD; 346/74.1

[56] References Cited

U.S. PATENT DOCUMENTS

| | | | |
|---|---|---|---|
| 3,552,355 | 1/1971 | Flint | 118/657 X |
| 3,893,416 | 7/1975 | Eichorn | 118/657 X |
| 3,985,099 | 10/1976 | Nagashima et al. | 427/18 X |

*Primary Examiner*—John P. McIntosh

[57] ABSTRACT

A magnetic image decorator is disclosed wherein one or more cooperating magnetic decorator rolls which are supplied with toner particles are fitted with knife blades adapted to cause the toner particles to flow in a standing wave against a member such as a drum or belt carrying a latent magnetic image.

8 Claims, 3 Drawing Figures

MAGNETIC IMAGE DECORATOR

BACKGROUND OF THE INVENTION

In the past, various techniques have been used to apply magnetically attractable toner particles to a latent magnetic image. Generally this has been achieved by cascading the magnetically attractable toner particles over the latent magnetic image such as in the manner disclosed in U.S. Pat. No. 3,698,005. An alternate technique is disclosed in U.S. Pat. No. 3,640,247 wherein a nonmagnetizable tube containing a rotatable row of bar magnets is used to deliver toner particles from a sump to a shelf adjacent a drum having a latent magnetic image in the surface thereof.

The present invention relates to an apparatus and method for applying magnetically attractable toner particles to a latent magnetic image in such a way that very wide range of imaging surface speeds can be achieved with excellent uniformity and density across the width of the latent magnetic image.

SUMMARY OF THE INVENTION

In accordance with the present invention an apparatus and method is provided for decorating a latent magnetic image with magnetically attractable toner particles. The invention involves providing a knife blade which interrupts a layer of toner particles on a magnetic roll and fluidizes the toner particles into a fluidized standing wave of particles which contacts a latent-magnetic image-bearing surface thereby decorating said image with toner particles.

BRIEF DESCRIPTION OF THE DRAWING

Referring to FIG. 1 a translucent document such as an engineering drawing which is to be copied is place on shelf 11 and urged against gate 12. The copier is then activated to lift the gate 12 and lower feed roll 13 into contact with the document. Feed roll 13 feeds the document into the nip between endless belt 14 and drum 15. Endless belt 14 is made of a transparent film such as poly(ethylene terephthalate) film and is guided by rolls 16, 17 and 18. The surface of drum 15 may also be such a film coated with an electrically conductive layer which is grounded. The surface of the electrically conductive layer is coated with a layer of ferromagnetic material having a Curie point of from 25° to 500° C. such as acicular chromium dioxide in an alkyd or other suitable binder.

Figure 1:
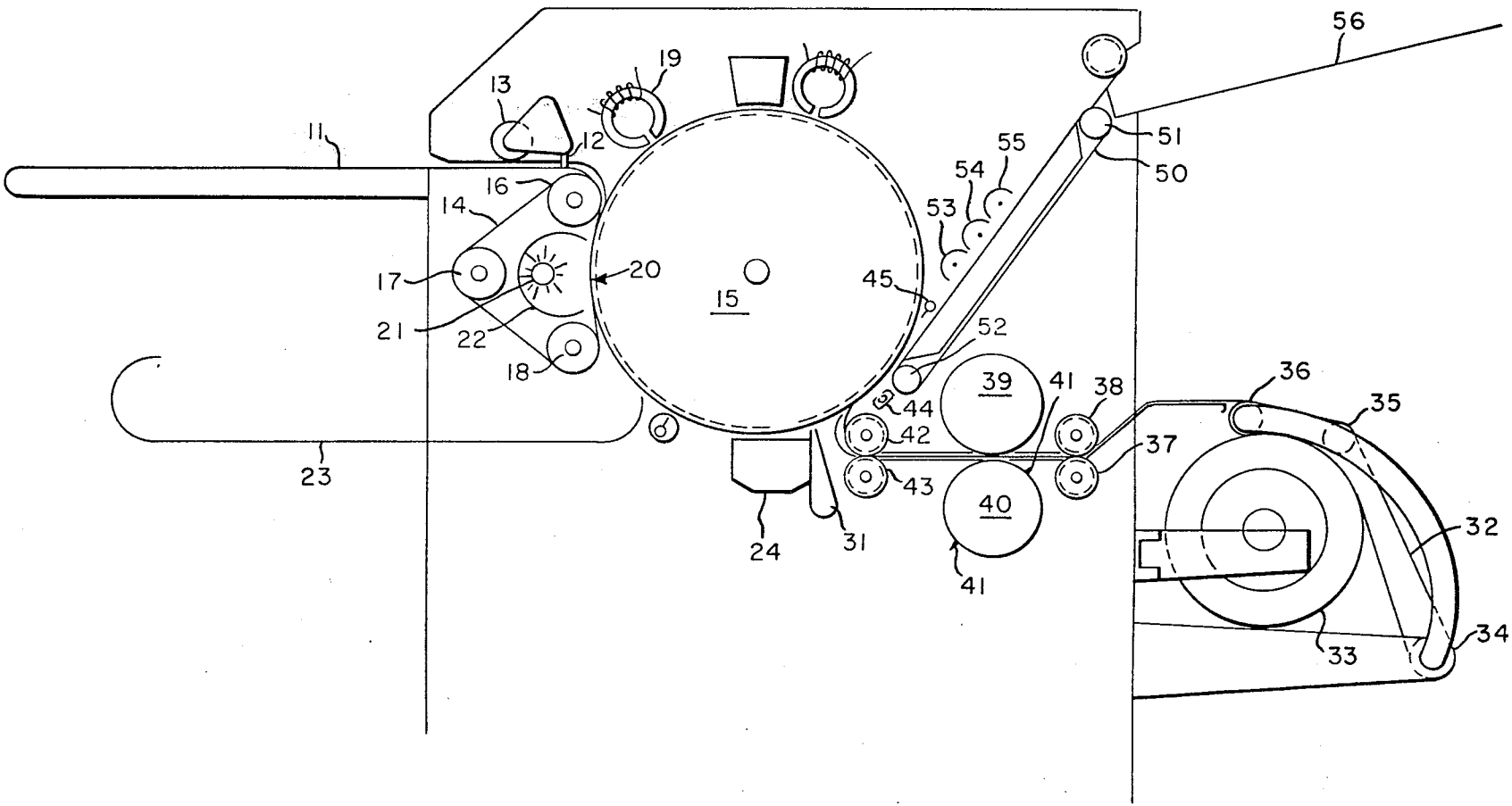
FIG. 1 is a schematic view of one embodiment of a printer using the decorator of the present invention.

Drum 15 rotates in a counterclockwise direction. The ferromagnetic coating on the drum is uniformly magnetized by premagnetizer 19, which records a periodic pattern. From 250 to 1500 magnetic reversals per inch (10 to 59 per mm) on the magnetizable surface is a suitable working range with from 300 to 600 magnetic reversals per inch (12 to 24 per mm) being preferred. Then the magnetized drum surface in contact with the document is moved past exposure station indicated generally at 20. The exposure station consists of lamp 21 and reflector 22. The surface of drum 15 is exposed stepwise until the entire document has been recorded as a latent magnetic image on the surface of drum 15. The chromium dioxide as used herein has a Curie temperature of about 116° C. The various indicia on the document being copied shades the areas of chromium dioxide over which such printing is situated during exposure thereby preventing their reaching the Curie point. Thus, after exposure, the surface of drum 15 will have magnetized areas of chromium dioxide corresponding to the indicia bearing areas of the document being copied, other areas not so shaded being demagnetized.

After exposure, the document being copied is dropped into tray 23.

Figure 2:
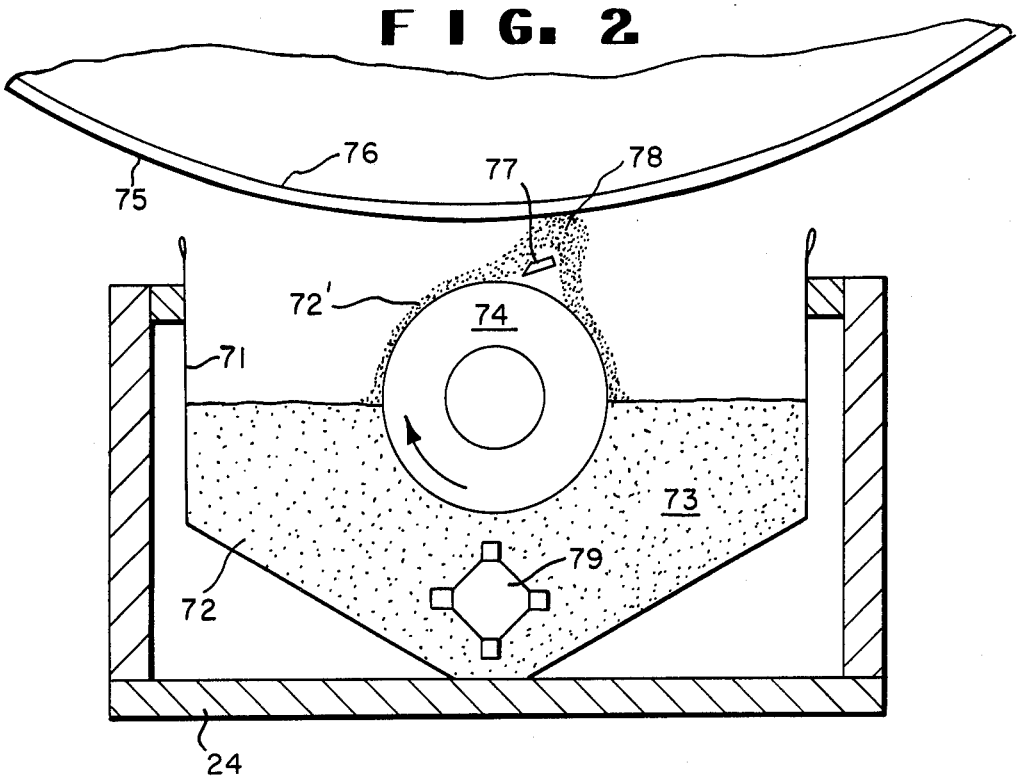
FIG. 2 is a cross-sectional elevation of the decorator of the present invention showing the process somewhat schematically.

The imagewise magnetized drum 15 is rotated past a toner decorator 24 the details of which are shown in FIG. 2. The toner is a fine powder of a magnetic material such as iron oxide encapsulated in a thermoplastic resin having a relatively low softening point of from 70° C to 120° C. The toner generally will have an average particle size of from 10 to 30 microns. A vacuum knife 31 is used to remove whatever toner particles may have adventitiously become attached to the demagnetized areas of the chromium dioxide on the surface of drum 15. The paper 32 on which the copy is to be made is fed from roll 33 around idler rolls 34, 35, and 36 to feed rolls 37 and 38. Backing roll 39 cooperates with roll 40 equipped with cutting edges 41. Rolls 39 and 40 are activated by means not shown to cut the paper to the same length as the length of the document being copied. The paper is then fed into physical contact with the surface of drum 15 by rolls 42 and 43. The paper 32 in contact with the surface of drum 15 is fed past corona discharge device 44. Corona discharge device 44 preferably is of the type known as a Corotron which comprises a corona wire spaced about 11/16" (17.5 mm) from the paper and a metal shield around about 75 percent of the corona wire leaving an opening of about 90° around the corona wire exposed facing paper 32. The metal shield is insulated from the corona wire. The metal shield is maintained at ground potential. Generally the corona wire will be from 0.025 to 0.25 mm in diameter and will be maintained at from 3000 to 10,000 volts. The corona wire may be at either a negative or positive potential with negative potential being preferred. The corona discharge from the wire charges the backside of the paper which generates a force on the toner particles adequate to overcome their magnetic attraction to the magnetized chromium dioxide on the surface of drum 15, even at saturation magnetization, and thereby cause said toner particles to be transferred to paper 32 upon its removal from the transfer zone. There is only a light amount of pressure between paper 32 and the surface of drum 15 (i.e., merely enough to hold them adjacent each other). The pressure between paper 32 and drum 15 is essentially entirely generated by the electrostatic attraction generated by corona discharge device 44. The paper 32 is then removed from the surface of drum 15 by the action of vacuum belt 50 in conjunction with the action of puffer 45 that forces it onto the surface of endless vacuum belt 50 driven by rollers 51 and 52. The paper 32 is then fed under fusers 53, 54, and 55 which heat the thermoplastic resin encapsulating the ferromagnetic material in the toner particles causing them to melt and fuse to the paper 32. The decorated paper is then fed into tray 56.

Referring now to FIG. 2 decorator 24 comprising tray 71 is partially filled with toner 72 to form a toner sump 73. A magnetic roll 74 is partially immersed in sump 73 and rotates in the direction of the arrow. This lifts a layer of toner 72' in a manner well-known forwarding the layer of toner 72' to close proximity with latent magnetic image 75 carried on an imaging surface 76 which ordinarily is mounted on a drum. A blade 77, or doctor knife, lifts the layer of toner 72' from the surface of magnetic roll 74 and fluidizes it forming a standing wave of fluidized toner 78 which contacts latent magnetic image 75 decorating it, i.e., developing an image of toner particles on the imaging surface 76. This optionally may be repeated using one or more parallel magnetic rolls. We have found that one roll is adequate for a 5 inch wide system yielding excellent density. Toner not used in decorating is returned to toner sump 73 and kept stirred by agitator 79. This is operated at a speed maintaining a well stirred sump without clumping and without excess dusting. A stripper blade, not shown, may assist in the returning toner to the sump if the magnetic roll is of the type with the entire periphery magnetized.

In decorating images we operate the magnetic roll 74 at a speed which yields fluidization of the toner wave which has then a well defined shape, but which does not create excess dusting which is about 60 feet per minute (30 cm per second). We find that, with a fluidized wave of toner, a wide range of image drum speeds can be accommodated, i.e., 30 to 150 surface feet per minute (15 to 76 cm per second).

The fluidized wave we produce is characterized by a stable constant cross-section, uniform in height, and without significant oscillation or undulation. The wave is a standing wave and the toner material at the crest moves substantially co-current with the surface bearing the latent image. In this region at the crest the toner particles are highly fluidized but have low kinetic energy and are removed sufficiently from the influence of the magnetic roll to be influenced by the magnetic latent image.

Parameters which are important in producing such a preferred fluidized wave are:

| | |
|---|---|
| Roll | Magnetic strength |
| | Surface speed |
| | Depth of toner layer |
| Blade | Wetted length |
| | Angle to magnetic roll |
| | Position on magnetic roll |
| | Clearance |
| Toner | Flowability |

The magnetic roll 74 may be constructed in any of the known ways. Thus, permanent magnets might be mounted on the rotating surface or the rotating surface might be non-magnetic turning around a core having fixed magnets or so on.

Figure 3:
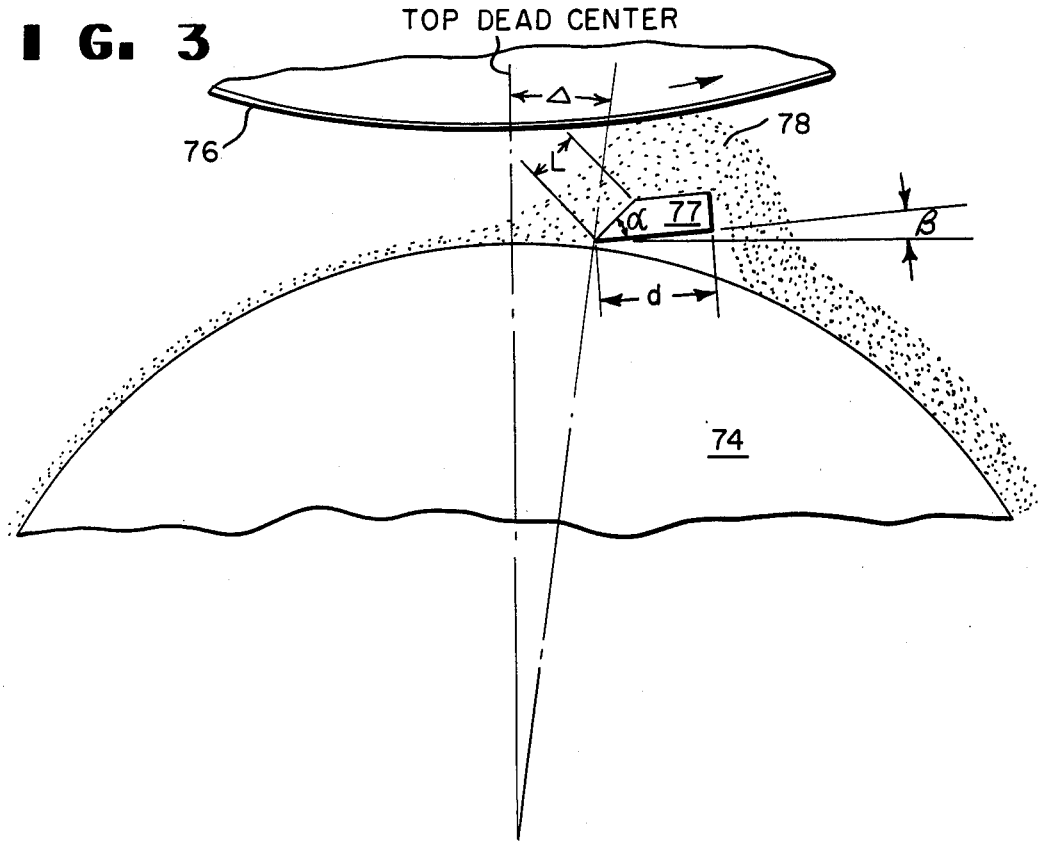
FIG. 3 is an enlarged view of that portion of FIG. 2 showing the doctor knife.

The geometry and disposition of doctor knife 77 must be controlled to perform this invention in optimum fashion. Referring to FIG. 3, the shape of the knife blade is seen in cross-section as a wedge with an edge angle "$\alpha$", a wedge face length "L", and a blade length, "*d*". This shape blade eliminates stagnant regions of toner between the blade and the decorator roll. For a surface speed of 30 to 150 feet per minute (15 to 76 cm per second) of imaging surface 76 (drum) having a latent magnetic image thereon and using a roll 84 with a diameter of about 2 inches (5 cm) with a field strength of 480 Gauss, angle "$\alpha$" may be varied from 30° to 45°. We prefer 30° for our preferred 60 surface feet per minute (30 cm per second) of imaging. Wedge face "L" whose length is dependent on surface velocity of the magnetic roll and toner flow characteristics, but limited by strength requirements, may be set from 1/16 to ¼ inch (1.6 to 6.4 mm) with ⅛ inch (3.2 mm) preferred. Face "L" is shown as flat. In practice it may also be either concave or convex. Blade length "*d*" may be from ⅛ to ⅜ inch (3.2 to 9.6 mm) with ¼ inch (6.4 mm) preferred. The blade is held under tension. Blade to roll clearance should be minimized without allowing contact. Runout limits the practical value to about 2 to about 5 mils (50 to 127 microns).

Again referring to FIG. 3, the position of blade 77 has been found to depend on surface speed of the magnetic roll, toner flow characteristics, and relationship of gravity to magnetic roll location and is, in the figure, delineated by position angle "Δ" and attitude angle "B". We prefer to set position angle "Δ" at 15° from Top Dead Center of the magnetic roll in the direction of the motion of its surface as shown in FIG. 3 when operating at our preferred magnetic roll surface velocity of 60 feet per minute (30 cm per second). In order to form a standing wave of fluidized toner without excessive dusting at higher surface velocities of the magnetic roll, we find it necessary to shift angle "Δ" to as much as −15°. Since these settings "Δ" and "B" are sensitive to toner characteristics, they are best determined experimentally as is the amount of penetration of the imaging surface 76 into the fluidized wave of toner 78. In this latter instance, we find that under 0.025 inch (0.625 mm) penetration yields sparse decoration and over 0.100 inch (2.54 mm) penetration yields an unacceptable increase in background. For our preferred imaging surface speed, we prefer a penetration of about 0.050 inch (1.27 mm).

I claim:

1. A decorator adapted to apply magnetically attractable toner particles to a surface containing a latent magnetic image comprising a rotatable magnetic roll, a knife blade disposed between said rotatable magnetic roll, and said surface containing the latent magnetic image, said knife blade having a fixedly mounted wedge the knife edge of which is facing into the direction of rotation of said rotatable magnetic roll adapted to create a stable constant cross section fluidized standing wave of toner particles which wave is uniform in height without significant oscillation or undulation and which fluidized standing wave of toner particles comes into contact with said surface containing the latent magentic image upon rotation of said rotatable magnetic roll.

2. The decorator of claim 1 wherein the knife blade is from about ⅛ to about ⅜ inch in width measured in the direction generally parallel to the flow of toner over said knife blade.

3. The decorator of claim 2 wherein the edge angle of the two faces forming the knife blade engaging the toner particles is from about 30° to about 45°.

4. The decorator of claim 3 wherein the edge of the knife blade engaging the toner particles is from about 15° before to about 30° after top dead center of the rotatable magnetic roll.

5. A process of applying magnetically attractable toner particles to a surface containing a latent magnetic image comprising supplying said toner particles to a rotating magnetic roll, and causing said toner particles to flow in a stable constant cross section fluidized wave which wave is uniform in height without significant oscillation or undulation, over a knife blade the knife edge of which is facing into the direction of flow of the toner disposed between said magnetic roll and said surface containing a latent magnetic image whereby a portion of said magnetically attractable toner particles come into contact with and are magnetically held by said surface containing a latent magnetic image.

6. The process of claim 5 wherein the knife blade is from about $\frac{1}{8}$ to about $\frac{3}{8}$ inch in width measured in the direction generally parallel to the flow of toner over said knife blade.

7. The process of claim 6 wherein the edge angle of the two faces of the knife blade engaging the toner particles is from about 30° to about 45°.

8. The process of claim 7 wherein the edge of the knife engaging the toner particles is from about 15° before to about 30° after top dead center of the magnetic roll.

* * * * *